10/8/85 OR 4,545,782

United States Patent [19]

Niemiro et al.

[11] Patent Number: 4,545,782

[45] Date of Patent: Oct. 8, 1985

[54] ANTI-DOG-EAR DEVICE FOR A FOLDING APPARATUS

[75] Inventors: Josef W. Niemiro, Berwyn; Eugene Skipor, Elmwood Park, both of Ill.

[73] Assignee: Rockwell International Corporation, Pittsburgh, Pa.

[21] Appl. No.: 459,565

[22] Filed: Jan. 20, 1983

[51] Int. Cl.[4] ..... B65H 45/16

[52] U.S. Cl. ..... 493/425; 493/431; 493/444

[58] Field of Search ..... 493/406, 410, 416, 417, 493/421, 426, 427, 431, 435, 439, 440, 442, 443, 444, 445, 454

[56] References Cited

U.S. PATENT DOCUMENTS

| | | | |
|---|---|---|---|
| 2,985,449 | 5/1961 | Dietrich | 493/431 |
| 3,901,501 | 8/1975 | Kistner | 493/444 |
| 4,053,150 | 10/1977 | Lane | 493/444 |
| 4,279,410 | 7/1981 | Bolza-Schünemann | 493/427 |

FOREIGN PATENT DOCUMENTS

| | | | |
|---|---|---|---|
| 2837392 | 2/1980 | Fed. Rep. of Germany | 493/443 |
| 372609 | 5/1932 | United Kingdom | 493/431 |

*Primary Examiner*—E. Michael Combs

[57] ABSTRACT

This invention provides an apparatus for folding sheet products, such as newspapers or the like, which includes a pair of cooperating fold rolls, a sheet supporting surface located above the fold rolls, a rotatable cage assembly carrying a tucker blade that tucks a sheet product into the nip of the fold rolls during each revolution of the cage assembly, and means mounted on the rotating cage assembly to substantially fill the space between the cage assembly and the sheet supporting surface during the time when the trailing edges of the folded product approach each other as the product is drawn through the fold rolls.

4 Claims, 4 Drawing Figures

ANTI-DOG-EAR DEVICE FOR A FOLDING APPARATUS

BACKGROUND OF THE INVENTION

The present invention relates to an improved apparatus for quarter folding a newspaper that has already been shaped into the conventional half-folded form. Specifically, the apparatus includes means associated with the tucker blade assembly that extends downwardly from a rotating cage on which the tucker blade is mounted into the space between the cage and a newspaper supporting table located above the fold rollers at the time that the newspaper is being drawn down into the rolls for folding.

The production of folded articles such as newspapers or the like generally comprises printing the desired subject matter on a travelling web, running the web over a former to fold it in the longitudinal direction and then subsequently cutting the lengthwise folded material into pieces of the appropriate length. These cut pieces are then half folded by suitable folder and delivered to a conveyor belt in the standard newspaper configuration size. By "standard newspaper size," it is meant the half-folded product in which the newspaper has two folded edges and two cut edges, the one folded edge being transverse to the length of the newspaper about midway between the ends thereof and the other folded edge extending along the lefthand longitudinal side of the newspaper. The two extremities and the other longitudinal edge are of course free, with the two transverse free ends being adjacent to each other because of the longitudinal center fold. While this configuration constitutes the larger proportion of newspaper production, in many instances, it is desired to again fold the already half-folded product, this being referred to as quarter folding, to produce an article of tabloid size. If a tabloid is to be produced, then a further cut must be made to free specific folded edges. However, in some cases, the half-folded product is quarter folded merely for mailing or other handling purposes.

In the past, during the quarter folding operation, it was found that when the folded edges are brought into contact with the free edges, the free edges bounce or fly away and then are folded back on themselves as they go through the fold rolls, thereby producing what are known as "dog-ears." In those instances where mailing is the cause for the product to be quarter folded, it often occurs that the dog-ears are located at the site where automatic equipment attaches mailing tags or labels, this constituting a handling problem.

The problem of dog-ears occuring during folding operations in the production of newsprint is recognized in the art and two proposals for reducing the severity of the dog-ear effect can be found in U.S. Pat. Nos. 2,160,198 and 4,053,150.

It is a principal object of this invention to provide a simple yet effective apparatus for reducing the occurrence of dog-ears in quarter-folded products such as newspapers and the like.

It is an additional object of this invention to provide an attachment to the existing tucker blade apparatus that serves to reduce the volume of space between it and the fold rolls so that the ends of the newspaper being drawn together will be confined and not be allowed to fly against each other.

BRIEF DESCRIPTION OF THE DRAWINGS

Other objects and advantages of this invention will be in part obvious and in part explained in reference to the accompanying specification and drawings in which.

DESCRIPTION OF THE PREFERRED EMBODIMENT

Figure 1:
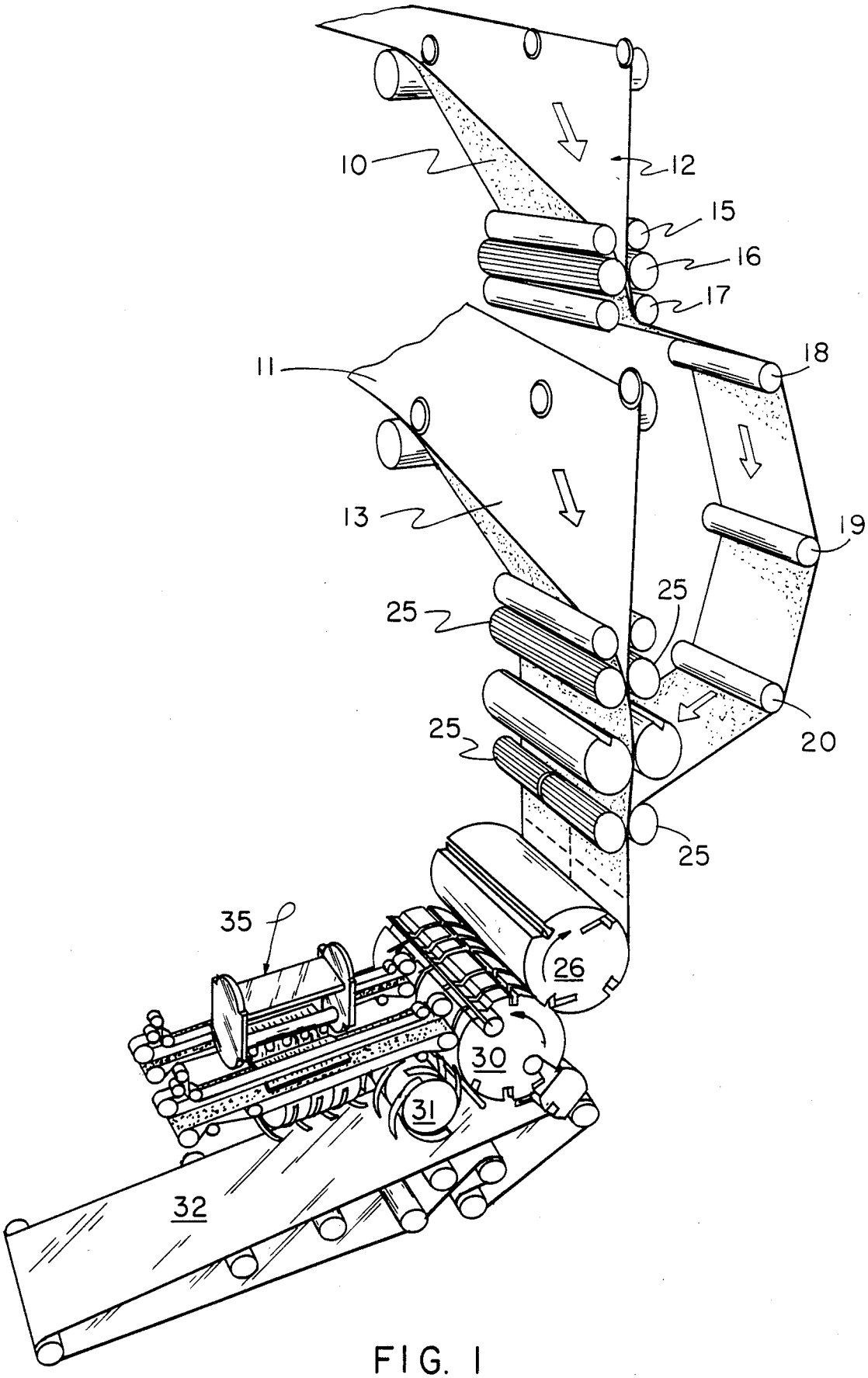
FIG. 1 is a schematic perspective showing the manner in which web newsprint arrives from the print, is cut, half folded, and then quarter folded for delivery toward the mailroom.

The general manner in which printed web is converted into folded-sheet product can best be seen by referring to FIG. 1 where, in the upper portion, two webs are shown approaching the formers and then being cut and either half or quarter folded for final delivery.

Referring more particularly to this drawing, it will be seen that travelling webs 10 and 11 travel over the upper former 12 and former 13, respectively. When travelling over the formers, the web is folded on back on itself so that it has two loose edges and one folded edge and now consists of a two-ply material. Following the path of the web 10 from the upper former 12, it will be seen that it passes through upper forming rollers 15, upper nipping rollers 16, idler roller 17, compensating roller 18, idler rollers 19 and 20, and finally, into the nipping rollers 25. From the nipping rollers 25, the sheet is fed downwardly around the cutting cylinder 26 which is of conventional design and is then cut into lengths which are usual in the production of newsprint. The paper having been cut by cylinder 26 is then seized in its middle by the half-fold jaw cylinder 30 which produces a single center fold in the newsprint that extends laterally of the length of the sheet. In this configuration, the newspaper thus produced has a folded edge in the center running transversely and also one folded edge along the lefthand side of the product. If this form of fold is to be the final one, as it would be for most daily newspapers, then the article is released into the half-fold delivery fly 31 which then deposits the successful half-folded products onto delivery belt 32 so that the printed newspapers are in shingled, overlapping or imbricated position.

If the newsprint is to be quarter folded for the production of a tabloid or for mailing purposes, then the mechanism will be so arranged that the paper rather than being delivered to the half-fold delivery fly 31, will be delivered to the quarter folder 35.

Figure 2:
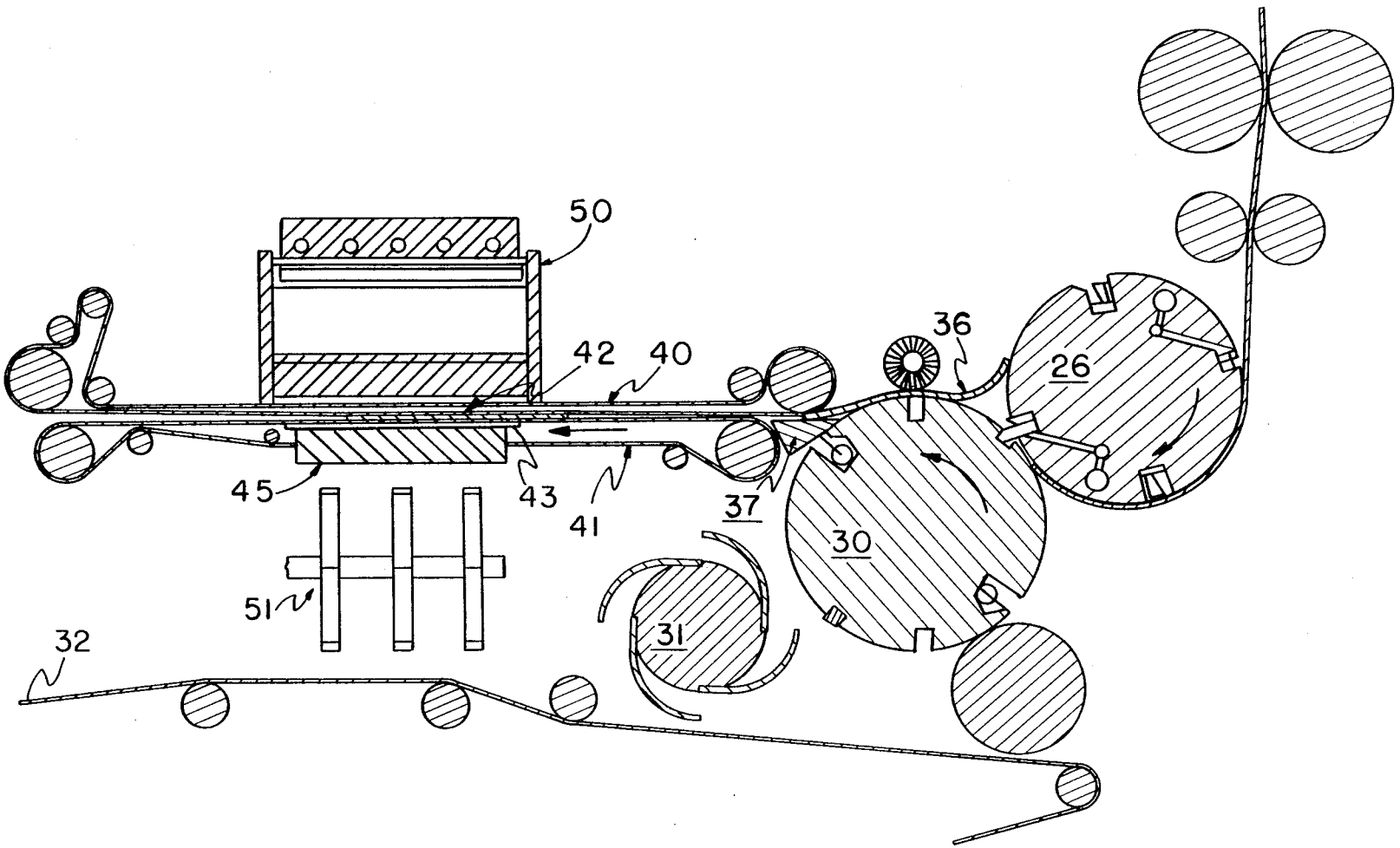
FIG. 2 is a schematic side elevation showing the cutter roll, half-fold roll, and the quarter-fold apparatus together with the half-fold delivery fly and exit conveyor.

For a better understanding of the apparatus as the newspaper product approaches the quarter fold, reference is made to FIG. 2 of the drawings. In this FIG. 2, the numeral 26 is the cutting cylinder which was referred to in connection with FIG. 1 and the numeral 30 designates the half-fold jaw cylinder. In the configuration here shown, the half-fold delivery fly is not used but, instead, the half-folded newsprint 36 exits across the stripper shoe 37 where it is advanced between the opposing endless belts 40 and 41. The endless feed belts 40 and 41 advance each successive half-folded paper 36 toward the quarter-folding zone 42 and newspaper support table 43 which is located above the fold rollers 45 and below the tucker blade assembly 50. The table 43 is provided with a slot 44 through which each successive newspaper is pushed by the tucker blade referred to hereafter. The numeral 51 designates the quarter-fold fly which takes the quarter-folded product and delivers it onto the conveyor system 32.

Figure 3:
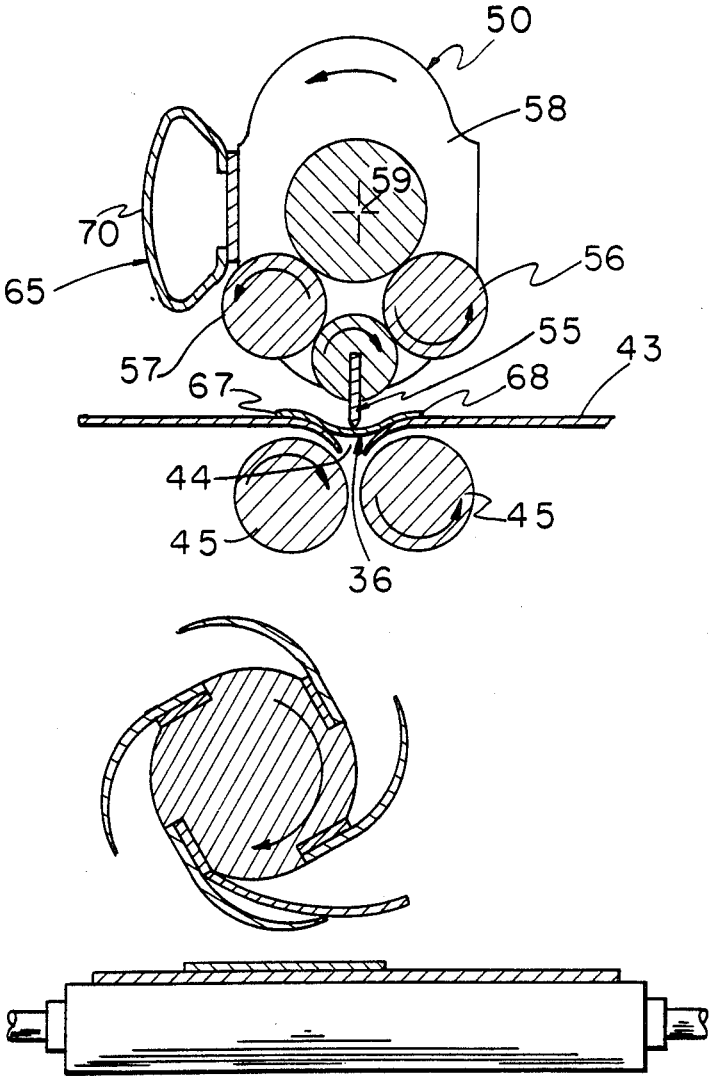
FIG. 3 is a somewhat schematic end elevation showing the tucker blade cage carrying the device which fills the volume between the cage and the fold rolls during at least a portion of the quarter-folding operation.

Referring to the FIG. 3 of the drawings, the tucker blade assembly 50 comprises a tucker blade 55 which is carried on an element which meshes with a pair of related gear elements 56 and 57 so that upon rotation of the cage 58 about axis 59, the blade will move between an extended position, such as that shown in FIG. 3, to an inverted or internal position after 90° rotation of the cage, and again, to an exterior position when the cage has travelled 180°. No tucking is performed when the blade is in its upper position but that is of no particular consequence.

Figure 4:
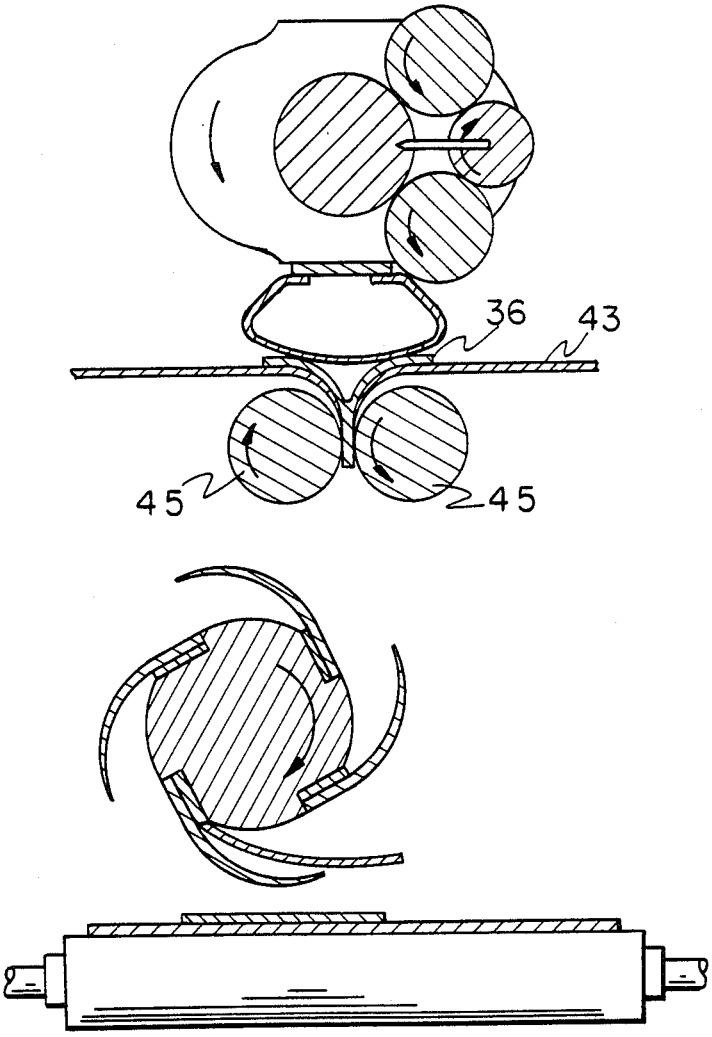
FIG. 4 is a figure similar to FIG. 3 but showing the tucker cage rotated by 90°.

The cage assembly has mounted on one side an element 65 which provides a means whereby the space between the cage assembly and the fold rolls 45 as well as the supporting table 43 can be substantially reduced during the time when the opposing trailing edges 67 and 68 of the paper being folded are approaching each other as the newspaper is drawn through the fold rolls. The operative position of the guide or shoe element 65 and the way that it maintains the trailing edges of the product 36 is best shown in FIG. 4 of the drawings.

It will be seen, again referring to FIGS. 3 and 4, that the guide shoe 65 is positioned on the rotating cage at a location about 90° removed from the position of the tucker so that it moves into the space between the cage assembly 50 and the supporting table 43 after the blade has tucked a newspaper into the nip of fold rolls 45. The guide shoe itself comprises an elongated member that is secured on one side to the cage by suitable means and it is provided with a generally arcuate outer surface 70 which provides a zone of decreasing volume, from the edges toward the center above slot 44 when it is located in the operative position shown in FIG. 4. This arcuate surface 70 is of greater length than the width of the slot 44 which extends through the supporting table 43 so that guiding of the trailing edges of the newspaper is provided beginning at an appreciable distance from the location where the newspaper is being drawn into the nip of fold rollers 45. This guiding restricting guide shoe 65 clearly provides an outer surface that efficiently guides the trailing edges of the paper being folded down toward the nip of rolls 45 and precludes them from slapping together and thereby causing the free edges to bounce and perhaps be formed into dog-ears.

It will be understood that the invention may be embodied in other specific forms without departing from the spirit and essential attributes thereof, and it is therefore desired that the present embodiment be considered in all respects as illustrative and not restrictive, and it will be further understood that each and every novel feature and combination present in or possessed by the mechanism herein disclosed forms a part of the invention included in this application.

What we claim is:

1. In an apparatus for quarter folding a half-folded newspaper having folded edges along two sides thereof and loose edges along the remaining two edges thereby, which apparatus includes:

a pair of cooperating fold rolls;

a surface located above the fold roll to receive half-folded newspapers, the surface having a slot through which a newspaper can be moved;

a rotating cage assembly located above the newspaper supporting surface;

a tucker blade carried on the rotating cage and movable to tuck a newspaper through the slot in the supporting surface during each revolution of the cage assembly, the combination comprising:

guide shoe means separate from said tucker blade and carried by the rotating cage assembly at a location thereon such that the space between the cage assembly and the supporting table is substantially reduced during the time when said guide shoe means is positioned opposite the opposing trailing edges of the newspaper as said edges are approaching each other as the newspaper is drawn through the fold rolls.

2. An apparatus as defined in claim 1 wherein said means carried by the rotating cage is located on the cage at a position approximately 90° removed from the position of the tucker blade so that it moves into the space between the cage assembly and the supporting table after the blade has tucked a newspaper into the nip of the fold rolls.

3. An apparatus as defined in claim 2 wherein said means carried by said rotating cage comprises an elongated shoe-like member that is secured on one side to the cage and has a generally arcuate outer surface.

4. An apparatus as defined in claim 3 wherein the generally arcuate outer surface of said shoe-like member is of greater length than the width of the slot in the supporting surface so that when said shoe is positioned above the slot, the outer surface thereof extends outwardly and upwardly away from its line of closest proximity to the nip of the fold rolls.

* * * * *